US005445000A

United States Patent [19]

Brown

[11] Patent Number: 5,445,000

[45] Date of Patent: Aug. 29, 1995

[54] LOCATION METHOD AND PANEL PRESSING APPARATUS

[76] Inventor: Gordon C. Brown, 11 Charmion Avenue, Glenvista, Johannesburg, Transvaal, South Africa

[21] Appl. No.: 142,805

[22] Filed: Oct. 25, 1993

[30] Foreign Application Priority Data

Oct. 28, 1992 [ZA] South Africa ..... 92/8325

[51] Int. Cl.[6] ..... B21D 1/12

[52] U.S. Cl. ..... 72/31; 72/705; 33/DIG. 1

[58] Field of Search ..... 33/555, DIG. 1; 72/705, 72/707, 447, 457, 35, 31

[56] References Cited

U.S. PATENT DOCUMENTS

| | | | |
|---|---|---|---|
| 2,165,504 | 7/1939 | Pfauser | 153/32 |
| 2,200,133 | 5/1940 | Mandl | 153/32 |
| 2,443,931 | 1/1948 | Stultz | 153/38 |
| 2,543,347 | 2/1951 | Bartlo | 72/392 |
| 2,599,786 | 6/1952 | Schmeling | 72/705 |
| 2,696,240 | 12/1954 | Crowder | 153/32 |
| 3,518,864 | 7/1970 | Pletronuto | 72/302 |
| 3,998,081 | 12/1976 | Hansen et al. | 72/56 |
| 4,073,181 | 2/1978 | Steinmann | 72/479 |
| 4,116,035 | 9/1978 | Malanaky | 72/389 |
| 4,144,091 | 3/1979 | Tran | 134/6 |
| 4,171,631 | 10/1979 | Butts | 72/54 |
| 4,252,008 | 2/1981 | Dibbens | 72/56 |
| 4,309,894 | 1/1982 | Connor | 72/457 |
| 4,388,890 | 1/1983 | Wester et al. | 116/204 |
| 4,754,637 | 7/1988 | O'Dell | 72/420 |
| 4,977,637 | 12/1990 | Demers | 15/104 |
| 5,005,449 | 4/1991 | Sorenson et al. | 81/152 |
| 5,078,281 | 1/1992 | Johnson | 111/88 |

FOREIGN PATENT DOCUMENTS

| | | | |
|---|---|---|---|
| 20843/76 | 6/1978 | Australia | F16M 11/04 |
| 29043/77 | 3/1979 | Australia | H01F 5/04 |
| 29931/77 | 4/1979 | Australia | H01F 7/13 |
| 31234/77 | 6/1979 | Australia | F16D 13/75 |
| 49409/79 | 3/1980 | Australia | C01D 11/30 |
| 52094/79 | 5/1980 | Australia | B25B 5/00 |
| 69697/81 | 10/1981 | Australia . | |
| 10276/83 | 9/1983 | Australia | G01M 17/00 |
| 40567/85 | 10/1985 | Australia . | |
| 42786/85 | 12/1985 | Australia | B60S 5/00 |
| 19014/88 | 10/1988 | Australia | B01B 5/25 |
| 27694/89 | 7/1989 | Australia . | |
| 27684/89 | 5/1990 | Australia | B60S 5/00 |
| 28750/89 | 7/1990 | Australia . | |
| 71100/91 | 9/1991 | Australia | B25B 5/02 |
| 71099/91 | 10/1991 | Australia | B25B 5/02 |
| 0585733 | 9/1933 | Germany . | |
| 2362103 | 7/1974 | Germany | B21D 1/12 |
| 3516637 | 11/1986 | Germany | B60S 5/00 |
| 1516748 | 7/1978 | United Kingdom . | |
| 2035566 | 6/1980 | United Kingdom | 33/DIG. 1 |
| 87/03549 | 6/1987 | WIPO | B60S 5/00 |
| 88/03446 | 5/1988 | WIPO | B21D 1/12 |
| 91/13723 | 9/1991 | WIPO | B25B 5/02 |

*Primary Examiner*—Lowell A. Larson
*Attorney, Agent, or Firm*—Ladas & Parry

[57] ABSTRACT

The invention concerns a method of locating and repairing dents in motor vehicle panels. The initial step in the method is to locate the dent in the panel. This is done by positioning a magnet and a metal ball on or adjacent to opposite surfaces of the panel so that the magnet and ball attract one another through the panel. The relevant one of the magnet or ball is to the location of the dent on one side of the panel with the result that the other of the magnet or ball moves to the dent on the other side of the panel. The magnet is typically carried by a mechanical pressing tool which can then be used to lever out the dent by working the metal around the dent.

10 Claims, 5 Drawing Sheets

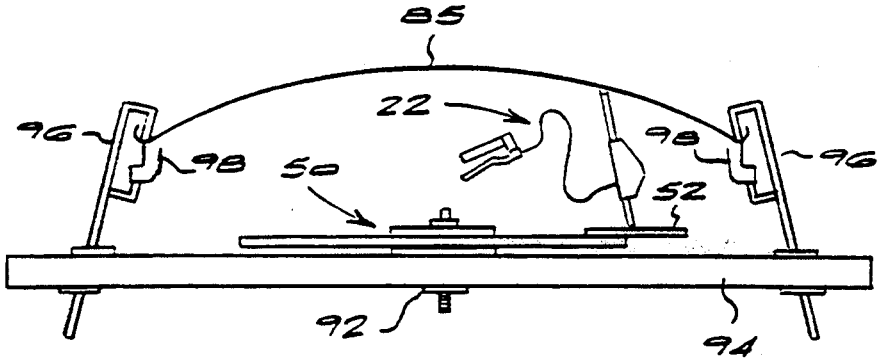
FIG 6
FIG 7
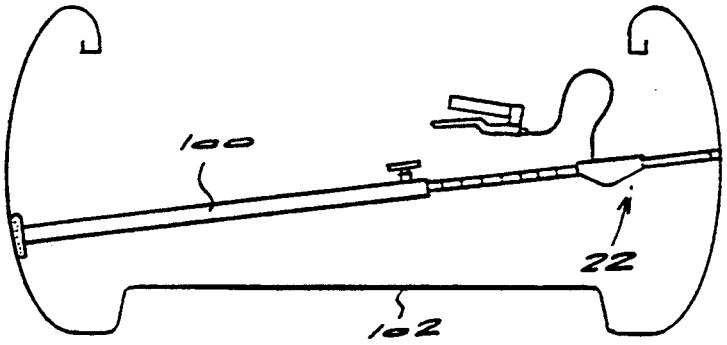
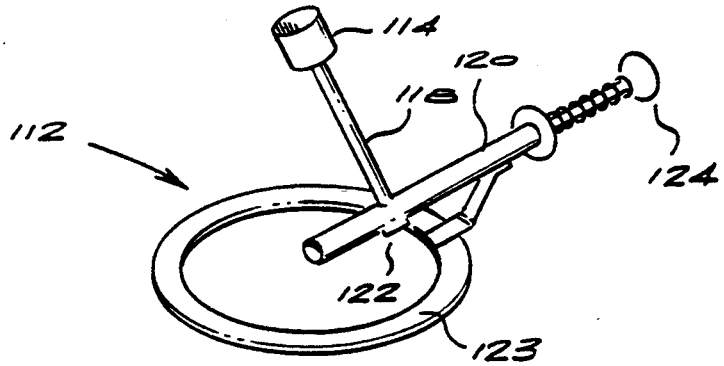
FIG 8

LOCATION METHOD AND PANEL PRESSING APPARATUS

BACKGROUND TO THE INVENTION

THIS invention relates to a method of locating and repairing dents in a motor vehicle panel. The invention also relates to a panel pressing device which may be used in such a method.

When panel-beating a vehicle, it may sometimes be necessary to locate a point on one side of a vehicle panel which is directly opposite a visible point on the other side of the panel, the first mentioned point being invisible from the other side. In particular, it may be desired to apply a panel pressing device or crowbar tool to one side of a motor vehicle panel, such point being directly opposite a known, visible point, such as a dent, on the other side of the panel.

The present invention seeks to provide a method and apparatus for doing this.

SUMMARY OF THE INVENTION

The invention provides a method of locating and repairing a dent in a motor vehicle panel, the method including the step of locating the dent in the panel by positioning a magnet and a metal ball on or adjacent to opposite surfaces of the panel so that the magnet and ball attract one another through the panel, and moving one of the magnet or ball to the location of the dent on one side of the panel with the result that the other of the magnet or ball moves to the dent on the other side of the panel.

The steps of locating and repairing the dent in the panel may be performed without removing the panel from the vehicle.

Furthermore, the method may include the steps of repairing the dent by providing a panel pressing device comprising a plunger having an operative end carrying or comprised by the magnet, and urging the plunger against the panel thereby to repair the dent.

The plunger may be manually urged, or more preferably, urged remotely in such a manner by means of a Bowden cable.

The method may include the further step of providing a support means defining a reaction surface on which the panel pressing device can be located so as to be interposed between the panel and reaction surface whereby the plunger can be urged against the panel to repair the dent.

The invention also provides a panel pressing device for repairing dents or treating irregularities in a motor vehicle panel, the device comprising a plunger having an operative end which can be urged against the panel, the operative end having or carrying a magnetised section provided at or towards the operative end of the plunger. More preferably, the device has a permanent magnet attached to the device at or towards the operative end of the plunger.

In a more particular preferred method according to the invention, a method of locating and repairing a dent in the surface of a motor vehicle panel comprises the steps of:

a) positioning a steel ball on a surface of the panel;

b) bringing, on the opposite side of the panel, a panel pressing device as summarised above towards the location of the ball to attract the ball through the panel, the movement of the ball as it follows the device thereby indicating the location of the device on the opposite surface of the panel so that the device can be brought to the location of the dent as indicated by the ball; and c) operating the device to repair the dent.

More preferably, the method may include the further step of heating the panel in the location of the dent.

BRIEF DESCRIPTION OF THE DRAWINGS

The invention will now be described in more detail by way of example only with reference to the accompanying drawings, in which

FIG. 6 shows a schematic view of the panel pressing device and holding means of the invention in use inside a vehicle cockpit;

FIG. 7 shows a schematic top view of the device shown in FIG. 2 in use to repair a vehicle fender;

FIG. 8 shows a pictorial view of a ball dispenser according to the invention;

DESCRIPTION OF EMBODIMENTS

Figure 1:
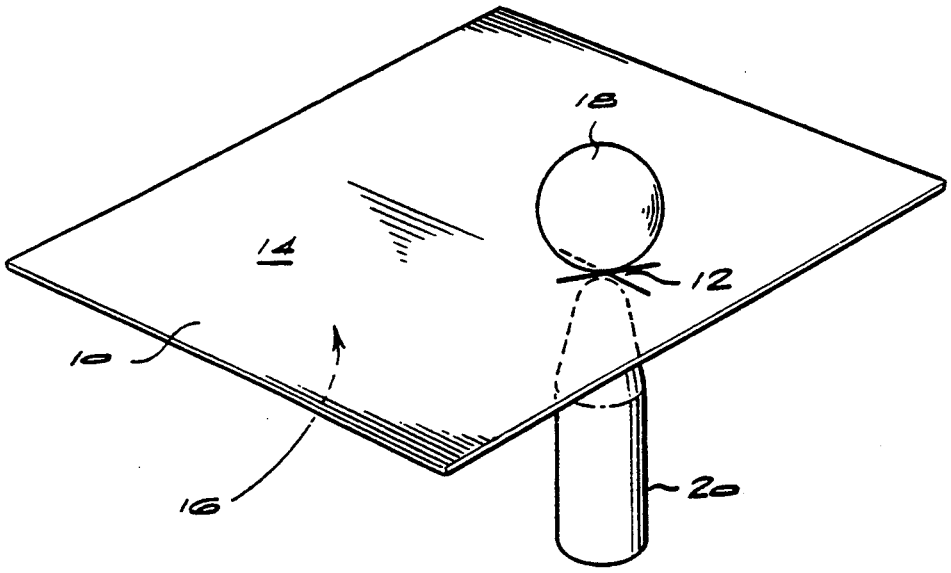
FIG. 1 shows a pictorial view of the apparatus used in a location method according to the invention.

A method of locating a dent in the surface of a motor vehicle panel is described initially in broad terms with reference to FIG. 1. In this Figure, a flat sheet of thin gauge steel representative of a panel is indicated with the reference numeral 10. Marked on one surface 14 of the sheet 10 is a point 12 and it is desired to locate a point on the opposite surface 16 of the sheet which is opposite to the point 12.

The equipment used in the method of the invention comprises a metal or steel ball 18 which is free to roll about on the surface 14 and a permanent magnet 20 which is held against the surface 16. Being of magnetic material, the ball 18 is magnetised by the magnet 20 and is attracted to it through the steel sheet when the magnet is brought close to the ball. The magnet 20 can now be moved about, possibly manually, over the surface 16, drawing the ball 18 with it as it goes.

An observer watching the surface 14 can give directions to another person who moves the magnet 20, in response to the directions, until such time as the ball 18 is brought to the point 12. When this point is reached by the ball, it is known that the magnet 20 is at the desired point on the surface 16.

The invention also extends to a situation where there is a magnet which is moved over the surface 14 and where there is a magnetizable object, or another magnet, which moves over the surface 16 in response to movements of the first magnet over the surface 14. Yet another possibility is for the magnet to be moved on the surface 16 and for a magnetizable object to be suspended, on a cord or the like, over the surface 14 so as to move freely in response to movements of the magnet.

This may be required when the sheet is so thick that the magnetic field of the magnet is not able to penetrate through to the other side of the sheet to attract the ball. To augment the magnetic field, a second magnet may be used instead of the ball, the second magnet being suspended over the sheet above the location of the first magnet so that the movement of the second suspended magnet indicates the location of the first magnet on the other side of the sheet.

It should also be noted that an electromagnet can be used instead of a permanent magnet.

The magnet 20 may for instance, be carried by or form part of a tool which is to be used on the surface 16 at the particular point which it is desired to locate.

In particular, the magnet 20 and ball 18 can be used in a method of repairing dents in a motor vehicle panel, as described more fully below.

Figure 2:
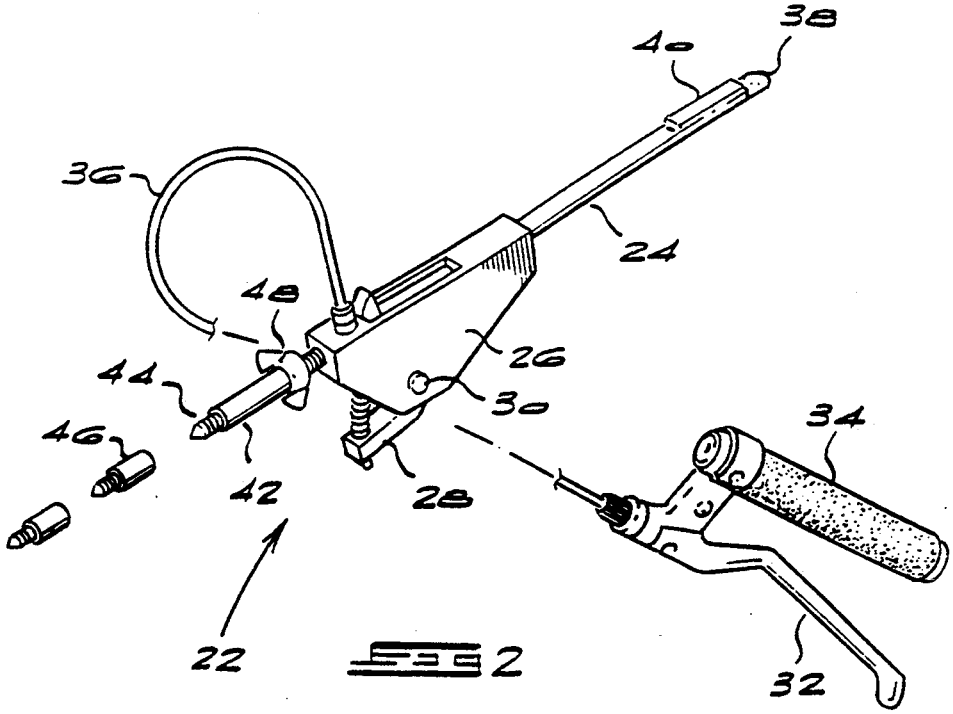
FIG. 2 shows a pictorial view of a panel pressing device according to the invention.

Referring now to FIG. 2, a panel pressing device 22 according to the invention is seen to comprise a plunger 24 which is slidably mounted in a housing 26. The plunger 24 can be urged out of housing 26 by means of a bell crank 28 pivotally mounted in the housing at a pivot 30. The bell crank acts against the bottom of the plunger to push it out of the housing. It will be seen that the bell crank is remotely operable by means of an actuating lever 32 which is attached pivotally to a handle 34. The lever 32 actuates the bell crank by means of a Bowden cable 36.

The end of the plunger remote from the housing defines an operative end 38 which in use can be urged against a panel to treat any irregularities or dents in the panel. The operative end may assume a variety of shapes to suit the various applications to which it is put. A magnetized section is provided at this operative end of the plunger in the form of a permanent magnet 40. The magnet 40 can be attached to the plunger by adhesive tape and is used to attract a steel ball through the motor vehicle panel.

The panel pressing device 22 also has means for locating the device securely on a reaction surface. With the device 22 located securely on a reaction surface, the plunger 24 can be urged by an operator out of the housing and against a panel. The locating means are in the form of a sharpened spigot 42 which protrudes from the bottom of the housing. The spigot is threaded at 44 so that an extension 46 can be fixed to the spigot. The threads of the spigot are also engagable with a complementally threaded bore provided in the housing. The length of the protruding spigot can thus be adjusted by screwing the spigot in and out of the housing. The spigot can be locked in any position by means of a wingnut 48.

Figure 3:
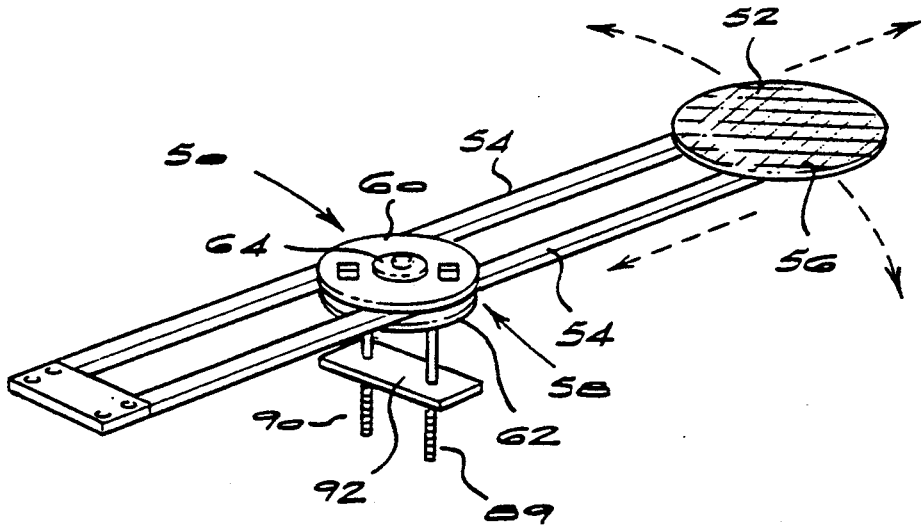
FIG. 3 shows a holding-means according to the invention.

Reference is now made to FIG. 3, which shows a holding means according to the invention. The holding means 50 comprises a base 52 which is carried by a pair of arms 54. The base has a reaction surface 56 on which the panel pressing device can be located. The base has a resilient upper layer which defines the reaction surface 56 and which increases the frictional engagement between the base and the sharpened spigot on the device. The device 22 can then be located securely on the base even when tilted over at an angle, such as when addressing a more remote or awkwardly situated irregularity in a panel.

The arms 54 of the holding means are held securely in a circular clamp 58. The clamp has upper and lower locking discs 60 and 62 which clamp the arms between them. Loosening an adjustment nut 64 enables the disc 60 to be rotated slightly to unclamp the arms 54. These arms can then be moved in any radial or circumferential direction about the central circular clamp 58 to move the base to any desired position. Once at a chosen position, the disc 60 is tightened again to clamp the arms and is locked by means of the nut 64. The base 52 is now immobilised and provides a firm reaction surface for the panel pressing device.

The holding means described above can be used in conjunction with a stand 66, or with a support which is passed through windows or doors on opposite sides of a vehicle cockpit.

Figure 4:
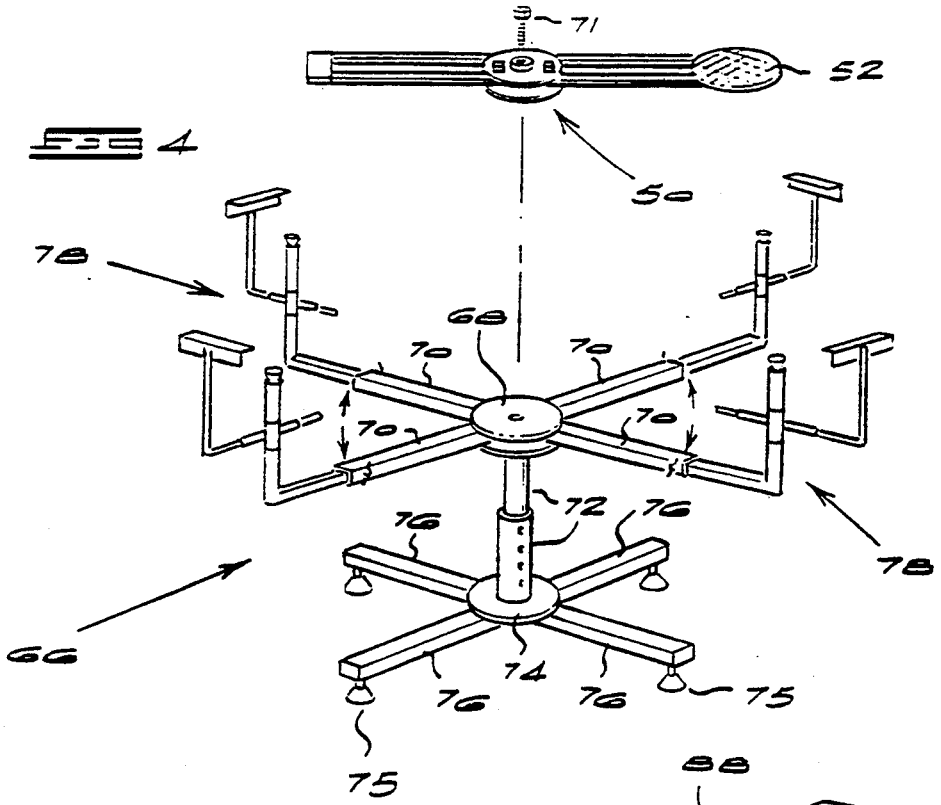
FIG. 4 shows a stand according to the invention.

A stand 66 according to the invention is shown pictorially in FIG. 4. The stand 66 has a central clamp 68 on which the holding means 50 can be mounted, and four radially extending arms 70. The clamp can be adjusted by means of an adjustment member 71 to allow scissors-type movement of the arms 70 about the central clamp 68. The adjustment member 71 can also be used to fix the holding means in various positions on the clamp 68. The clamp 68 is mounted on telescoping tubes 72 which can be locked relative to each other at any desired position so that the height of the stand can be adjusted. The telescoping tubes 72 also allow the arms 70 and platform 68 of the stand to be rotated relative to a support 74. The support 74 has four radially extending legs 76 with the free end of each leg 76 having a height adjustment screw 75 so that the stand can be located securely on an uneven surface.

The stand 66 has retaining means in the form of clamps 78 provided at the end of each arm 70. The clamps 78 can be used to retain a panel in a fixed position relative to the stand while the base 52, which can be held adjustably by the holding means 50 in any other position, provides a reaction surface for the panel pressing device. While supported on the base, the plunger 24 of the device 22 can be pressed against the panel being held by the clamps 78.

It will be seen that each radially extending arm of the stand comprises two telescoping members, with the outer telescoping member having an upstanding leg and a horizontal leg which can telescope in and out of the inner member. If necessary, this horizontal leg can be withdrawn completely from the inner member and then reinserted in a different orientation so that the upstanding leg is no longer upstanding, but assumes a substantially horizontal, or downwardly depending orientation. This may be required if the panel to be repaired is of an awkward shape.

Figure 5:
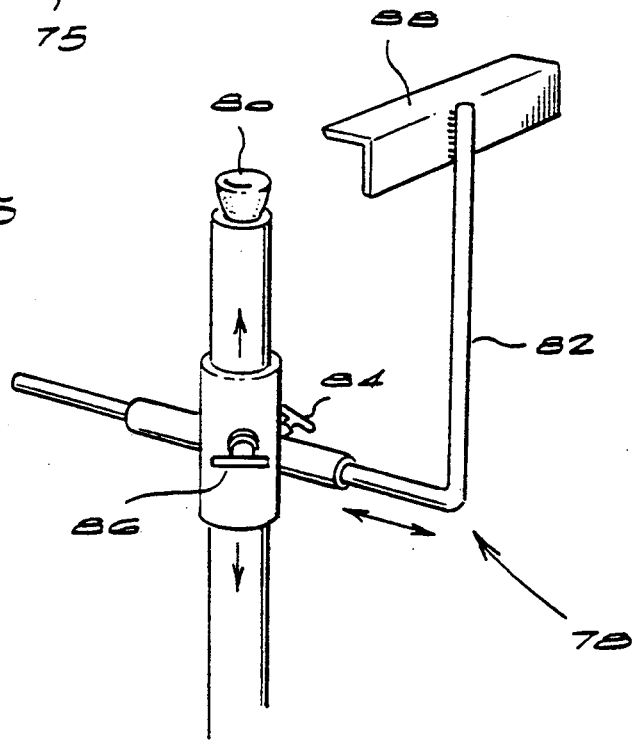
FIG. 5 shows a more detailed view of a clamp of the stand shown in FIG. 4.

A more detailed view of an upstanding leg of the stand is given in FIG. 5. The top of the leg is provided with a rubber pad 80 on which the underside of a panel can rest. In use, each arm of the stand will be adjusted so that the rubber pads support the panel near free edges of the panel. The panel can then be secured onto each pad by means of a clamping arm 82 in the form of a right-angled bar. As can be seen in the drawing, the clamping arm 82 is mounted adjustably to the upstanding leg and can be locked in a variety of positions by means of wingnuts 84 and 86. The clamping arm 82 has a length of angle section 88 attached to its upper end which engages with a free edge of the panel and when suitably positioned, holds the panel securely onto the rubber pad. The stand can then be used to hold a motor vehicle panel, such as a door, bonnet or boot, for example, in a rigid position so that irregularities or dents in the panel can be treated by the panel pressing device 22.

As mentioned above, the holding means 50 can also be mounted on a support passed through windows or doors on opposite sides of a vehicle cockpit. A pictorial view of this arrangement is shown in FIG. 6. This method can be used to fix dents or hail damage in a vehicle roof 85.

Referring again to FIG. 3, it will be seen that the lower disc 62 of the circular clamp 58 of the holding means 50 has depending threaded studs 89 and 90 having a plate 92 spanning across them. In FIG. 6, it will be seen that the studs 89 and 90 straddle a support in the form of a roof bar 94 with the plate 92 engaged underneath the bar. The plate 92 is bolted up tightly by nuts (not shown) on the studs to secure the holding means 50 securely on the roof bar 94. Once firmly secured in position, the holding means can be adjusted to position the base 52 and reaction surface where required. The roof bar is shown as being supported by gutter clamps 96 which engage with the gutter of the roof 85 and the upper door frames 98 of the vehicle, but could just as easily be supported by window sills on each side of the vehicle cockpit. In this configuration, the position of the base 52 can again be adjusted to provide a firm reaction surface for the panel pressing device 50 to repair a dent in the roof.

The panel pressing device can of course be used on its own to repair dents in a vehicle bumper bar or fender for example. Referring to FIG. 7, where a top view of a vehicles fender 102 is shown schematically in outline, it will be seen that the reaction surface for the pressing device is provided by the fender bar itself.

Here, the device 22 is fitted with an adjustable extension 100 which abuts against an inner surface of one side of the fender so that the plunger 24 can be urged against a dent in the surface on the opposite side of the fender. Of course, the device could be supported off the floor, or any other convenient reaction surface.

Figure 9:
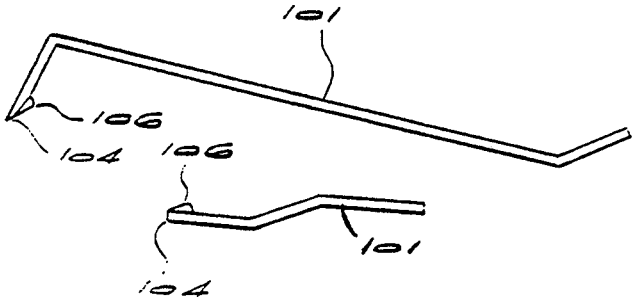
FIG. 9 shows a pictorial view of lever or crowbar tools according to the invention.

The invention also provides a lever or crowbar panel pressing tool 101 for treating irregularities in a panel. These tools, shown schematically in FIG. 9, can typically be used to fix dents in a vehicle roof, door or side body panel. The tools have operative ends 104 which can be urged about a fulcrum to act against a panel. Each tool has a permanent magnet 106 attached at or towards the operative end to attract a magnetic object, such as a steel ball, on the other side of a vehicle panel. The fulcrum for each tool is provided by a bracket 108 which is mountable to a panel adjacent a free edge thereof.

Figure 10:
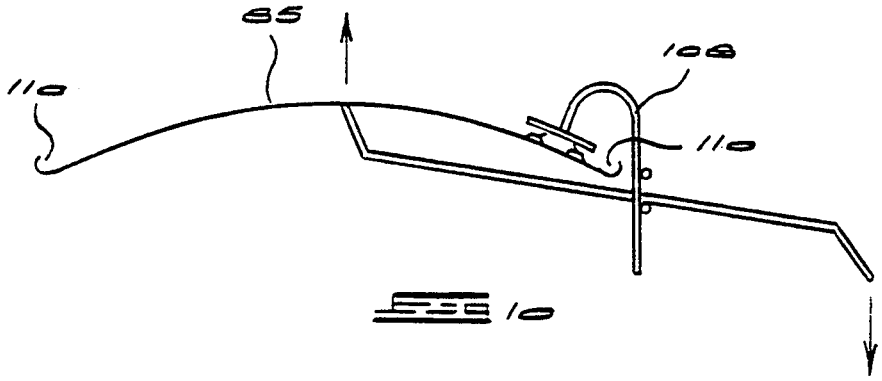
FIG. 10 shows a schematic view of a tool shown in FIG. 9 in use to repair a vehicle roof.

In FIG. 10, the bracket is shown as a modified form of gutter clamp which is engagable with one of the gutters 110 provided at the edges of the vehicle roof. In such a position, an operator can then apply a force downwardly on the handle of the tool to supply an upwardly directed force against the vehicle roof 85.

As an alternative to a bracket such as the bracket 108 to provide a fulcrum for the panel pressing tools, it would be possibly merely to provide an eyebolt or the like which is suspended from a bracket connected to the gutter of the vehicle. In this case, the panel pressing tool passes through the eye of the eyebolt, which then serves as a fulcrum for lever-type operation of the tool.

The invention also provides a ball dispenser 112, which is shown schematically in FIG. 8. The dispenser 112 has a ball reservoir 114 from which balls can drop down a hollow tube 118 in single file to be held discretely in position in an ejection tube 120 by a magnet 122. The ejection tube is fitted with a spring-loaded plunger 124 which can be plunged into the ejection tube to eject the balls one by one, into the centre of a ring 123.

The ring can be provided with a shroud (not shown) to retain an ejected ball and allow the dispenser to be used on an upright panel, such as a vehicle door panel for example, without losing an ejected ball. The underside of the ring is rubber lined to prevent scratching of the panel surface. The dispenser provides a convenient container for the steel balls used in the method provided by the invention.

The apparatus described above can be used to fix dents in a vehicle panel as follows:

Firstly, a steel ball is dispensed from the ball dispenser onto the dented surface of a panel. Secondly, on the other side of the panel, a panel pressing device 22 or crowbar tool 101 is brought towards the location of the ball. The permanent magnet attached to the operative end of the device or tool will attract the ball through the vehicle panel. By following the movement of the ball as it follows the device or tool on the other side of the panel, an operator will be able to bring the device or tool to the location of the dent. With the ball located in the dent, an operator is sure of operating the tool or pressing device so that it acts against or adjacent the dent.

The panel pressing device or crowbar tool can be worked around the dent to draw the stretched or expanded metal generally back into the plane of the panel to restore a smooth surface to the panel.

Figure 11:
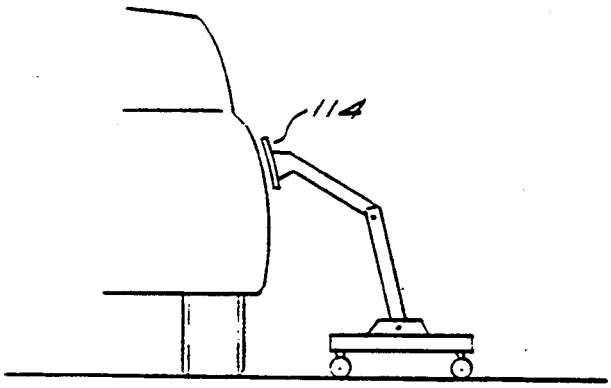
FIG. 11 shows a schematic view of a panel heater according to the invention.

To repair painted panels, the apparatus can be used to good effect in conjunction with a heater. Such a heater is shown schematically in FIG. 11. The heater is brought next to a dent in the panel to heat the surrounding paint. This renders the paint more flexible so that it will not crack while the dent is being repaired.

In cases where a vehicle has no gutters, modified tools can be provided that engage with the door opening surround of the vehicle, or with the window surround of the door.

I claim:

1. A method of locating and repairing a dent in a motor vehicle panel having a dented outer surface in which the dent is formed and an inner surface in which the dent is not readily visible, the method including the steps of: determining the location of the dent on the inner surface by: locating a magnetisable ball on the outer surface of the panel, arranging a panel pressing tool, which has an operative end carrying a magnet, adjacent the inner surface of the panel so that the magnet attracts the ball through the panel and causes the ball to move on the outer surface when the panel pressing tool is moved relative to the inner surface, moving the panel pressing tool relative to the inner surface in a manner to move the ball visibly on the outer surface to the location of the dent such that the panel pressing tool will then be located on the inner surface of the panel in a position opposite the dent on the outer surface thereof, and repairing the dent by operating the panel pressing tool to apply an outwardly directed pressing force to the inner surface of the panel at the position opposite the dent, thereby to remove the dent in the panel.

2. A method according to claim 1, wherein the steps of locating and repairing the dent in the panel are performed without removing the panel from the vehicle.

3. A method according to claim 2 comprising the further steps of providing support means defining a reaction surface and locating the panel pressing tool so as to react against the reaction surface when operated to apply an outwardly directed pressing force to the panel in the region of the dent.

4. A method according to claim 3 wherein the panel pressing tool comprises a housing, a plunger which is movable slidably relative to the housing, and a drive mechanism operable to urge the plunger in a direction out of the housing, the plunger having an operative pressing end carrying the magnet, and wherein the method comprises the step of locating the tool relative to the reaction surface in a manner for the tool to react against the reaction surface when the drive mechanism is operated to urge the plunger out of the housing so that the operative pressing end presses against the inner surface of the panel.

5. A method according to claim 2 wherein the panel pressing tool comprises a lever having an operative pressing end carrying the magnet, and wherein the method comprises the steps of securing a bracket to the vehicle and operating the lever, about a fulcrum provided by the bracket, so that the operative pressing end of the lever presses against the inner surface of the panel.

6. Panel repair apparatus for repairing a dent in a motor vehicle panel having a dented outer surface in which the dent is formed and an inner surface in which the dent is not readily visible, the apparatus including a magnetisable ball locatable on the outer surface of the panel, and a panel pressing tool which has an operative end carrying a magnet and which is locatable adjacent the inner surface of the panel so that the magnet attracts the ball through movement of the tool on the inner surface of the panel causing the ball to move visibly on the outer surface until the ball is positioned on the outer surface at the location of the dent therein such that the tool is then disposed at a position on the inner surface opposite the dent, the panel pressing tool then being operable to apply an outwardly directed pressing force to the inner surface of the panel at the position opposite the dent, thereby to remove the dent.

7. Panel repair apparatus according to claim 6 wherein the panel pressing tool comprises a housing, a plunger which is movable slidably relative to the housing, and a drive mechanism operable to urge the plunger in a direction out of the housing, the plunger having an operative pressing end carrying the magnet.

8. Panel repair apparatus according to claim 7 wherein the drive mechanism comprises a bell crank which is mounted pivotally relative to the housing and which acts against the plunger, the panel pressing tool including a Bowden cable which is attached to the bell crank and which is remotely operable to pivot the bell crank in a manner to urge the plunger out of the housing.

9. Panel repair apparatus according to claim 7 and comprising a free-standing support means defining a reaction surface, the panel pressing tool being locatable relative to the support means in a manner for the tool to react against the reaction surface when the drive mechanism is operated to urge the plunger out of the housing so that the operative pressing end of the plunger applies an outwardly directed pressing force to the inner surface of the panel.

10. Panel repair apparatus according to claim 6 wherein the panel pressing tool comprises a lever having an operative pressing end carrying the magnet, the apparatus comprising a bracket which is securable to a motor vehicle and which provides a fulcrum about which the lever is operable in a manner for the operative pressing end thereof to apply an outward pressing force to the inner surface of the panel.

* * * * *